US010589238B2

(12) United States Patent
Chong et al.

(10) Patent No.: US 10,589,238 B2
(45) Date of Patent: Mar. 17, 2020

(54) MIXING SYSTEM FOR CEMENT AND FLUIDS

(71) Applicant: SCHLUMBERGER TECHNOLOGY CORPORATION, Sugar Land, TX (US)

(72) Inventors: Jonathan Wun Shiung Chong, Sugar Land, TX (US); Kim A. Hodgson, Sugar Land, TX (US); Andrew Marlatt, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/069,209

(22) Filed: Mar. 14, 2016

(65) Prior Publication Data

US 2017/0259457 A1 Sep. 14, 2017

(51) Int. Cl.
*E21B 33/13* (2006.01)
*B01F 5/24* (2006.01)
(Continued)

(52) U.S. Cl.
CPC ..... *B01F 5/248* (2013.01); *B01F 3/1221* (2013.01); *B01F 3/1271* (2013.01); *B01F 7/164* (2013.01);
(Continued)

(58) Field of Classification Search
None
See application file for complete search history.

(56) References Cited

U.S. PATENT DOCUMENTS 4,239,396 A * 12/1980 Arribau ..... B01F 5/225 366/170.3
4,534,654 A 8/1985 Alt et al.
(Continued)

FOREIGN PATENT DOCUMENTS

AU 667469 B2 3/1996
AU 2002223029 B2 6/2007
(Continued)

OTHER PUBLICATIONS

Pierre et al., "Mixing cement by solids fraction instead of density", SPE 84584 presented at the SPE Annual Technical Conference and Exhibition, Denver, Colorado, USA, Oct. 5-8, 2003 (10 pages).

*Primary Examiner* — Andrew Sue-Ako
(74) *Attorney, Agent, or Firm* — Rachel E. Greene

(57) ABSTRACT

A technique facilitates mixing of cement slurry for use in a cementing application. At least one cement mixer is provided with a tank, e.g. a conical tank, having a powder cement blend inlet and a mixing liquid inlet. A cement slurry discharge may be positioned generally beneath the tank. A mixing assembly also is positioned below the tank and driven by a shaft. The mixing assembly is exposed to an interior of the tank and is used to mix the cement slurry when rotated by the shaft and to direct the cement slurry out through the cement slurry discharge. Additionally, a recirculation system comprises an inlet positioned to receive a portion of the cement slurry mixed in the mixing assembly. The recirculation system also comprises an outlet positioned to direct the portion back into the mixer to enhance mixing effects.

9 Claims, 5 Drawing Sheets

(51) Int. Cl.

| | |
|---|---|
| ***B01F 3/12*** | (2006.01) |
| ***B01F 7/16*** | (2006.01) |
| ***B01F 13/10*** | (2006.01) |
| ***B28C 7/04*** | (2006.01) |
| ***E21B 21/06*** | (2006.01) |
| ***B28C 9/00*** | (2006.01) |

(52) U.S. Cl.

CPC ..... *B01F 13/1022* (2013.01); *B28C 7/0454* (2013.01); *B28C 9/004* (2013.01); *E21B 21/062* (2013.01); *E21B 33/13* (2013.01)

(56) References Cited

U.S. PATENT DOCUMENTS 4,614,435 A * 9/1986 McIntire ..... B01F 5/226 366/164.6
5,046,855 A 9/1991 Allen et al.
5,109,933 A 5/1992 Jackson
5,289,877 A 3/1994 Naegele et al.
5,466,063 A 11/1995 Poyet et al.
5,515,921 A 5/1996 Cowan et al.
5,538,341 A 7/1996 Padgett et al.
5,570,743 A 11/1996 Padgett et al.
5,571,281 A 11/1996 Allen
5,736,594 A 4/1998 Boles et al.
5,775,803 A 7/1998 Montgomery et al.
5,806,594 A 9/1998 Stiles et al.
5,813,754 A 9/1998 Williams
5,897,699 A 4/1999 Chatterji et al.
5,904,419 A 5/1999 Arribau
6,055,874 A 5/2000 Onan et al.
6,227,294 B1 5/2001 Chatterji et al.
6,454,457 B1 9/2002 Banse et al.
6,488,088 B1 12/2002 Kohli et al.
6,491,421 B2 12/2002 Rondeau et al.
6,508,305 B1 1/2003 Brannon et al.
6,626,242 B2 9/2003 DAlmeida et al.
6,645,289 B2 11/2003 Sobolev et al.
6,662,873 B1 12/2003 Nguyen et al.
6,749,330 B2 6/2004 Allen
6,832,652 B1 12/2004 Dillenbeck et al.
7,048,054 B2 5/2006 Heathman et al.
7,252,147 B2 8/2007 Badalamenti et al.
7,293,609 B2 11/2007 Dealy et al.
7,325,629 B2 2/2008 Blaschke et al.
7,464,757 B2 12/2008 Pessin et al.
7,527,098 B2 5/2009 Santra et al.
7,543,645 B2 6/2009 Dykstra et al.
7,561,943 B2 7/2009 Dykstra et al.
7,614,451 B2 11/2009 Blaschke et al.
7,620,481 B2 11/2009 Dykstra
7,654,326 B1 2/2010 Santra et al.
7,680,617 B2 3/2010 Mazrooee et al.
7,694,739 B2 4/2010 Brothers et al.
7,708,071 B2 5/2010 Roddy et al.
7,896,076 B2 3/2011 Drochon
7,946,343 B2 5/2011 Caritey et al.
8,137,051 B2 3/2012 Glenn et al.
8,162,058 B1 4/2012 Chatterji et al.
8,215,823 B2 7/2012 Allen
8,267,175 B2 9/2012 Weaver et al.
8,377,201 B2 2/2013 Guynn et al.
8,419,266 B2 4/2013 Velayutham et al.
8,636,070 B2 1/2014 Goddard et al.
8,689,870 B2 4/2014 Bray et al.
9,033,040 B2 5/2015 Pisklak et al.
9,133,056 B2 9/2015 Skovby et al.
9,186,814 B2 11/2015 Ober
9,228,122 B2 1/2016 Chatterji et al.
9,228,940 B2 1/2016 Pelletier et al.
9,255,031 B2 2/2016 Pisklak et al.
9,315,713 B2 4/2016 Patil et al.
9,346,996 B1 5/2016 Lettkeman et al.
2003/0072208 A1* 4/2003 Rondeau ..... B01F 3/1271 366/16
2003/0202418 A1 10/2003 Scartezina
2005/0241538 A1 11/2005 Vargo, Jr. et al.
2006/0164914 A1* 7/2006 Goto ..... B01F 3/12 366/165.2
2008/0212397 A1 9/2008 Rondeau
2008/0298163 A1 12/2008 Pessin et al.
2009/0301353 A1 12/2009 Galvan Cazares et al.
2010/0157720 A1 6/2010 Woodmansee et al.
2011/0042088 A1 2/2011 Gassemzadeh et al.
2011/0056411 A1 3/2011 Schmidt et al.
2011/0127034 A1 6/2011 Vidick et al.
2012/0305250 A1 12/2012 Burts, Jr. et al.
2013/0118752 A1 5/2013 Hannegan et al.
2013/0248182 A1* 9/2013 Chong ..... E21B 33/14 166/285
2014/0238665 A1 8/2014 Welker
2014/0238676 A1 8/2014 Carelli et al.
2014/0269144 A1 9/2014 Ayo et al.
2014/0309936 A1 10/2014 Abbassian et al.
2015/0129210 A1 5/2015 Chong et al.
2015/0191642 A1 7/2015 Nguyen et al.
2015/0191643 A1 7/2015 De La Roij
2015/0218905 A1 8/2015 Chatterji et al.
2015/0260009 A1 9/2015 Rahman et al.
2015/0315875 A1 11/2015 Chatterji et al.
2015/0322761 A1* 11/2015 Hodgson ..... E21B 43/267 166/308.1
2015/0337620 A1 11/2015 Fonseca Ocampos et al.
2016/0017688 A1 1/2016 Chatterji et al.
2016/0046853 A1 2/2016 Chatterji et al.
2016/0046854 A1 2/2016 Gordon et al.
2016/0068735 A1 3/2016 Biddle et al.
2016/0084037 A1 3/2016 Brothers et al.
2016/0153260 A1 6/2016 Brothers et al.

FOREIGN PATENT DOCUMENTS

CA 2050594 A1 10/1990
CA 2305015 A1 10/2000
CA 2490928 C 6/2012
CA 2790432 A1 3/2014
CA 2816126 A1 3/2014
EP 0195484 B1 12/1991
EP 0721828 A2 7/1996
RU 2081295 C1 6/1997
RU 2101246 C1 1/1998
RU 2153060 C1 7/2000
RU 2161695 C2 1/2001
RU 2182566 C1 5/2002
RU 2184204 C2 6/2002
RU 2186942 C1 8/2002
RU 2203389 C2 4/2003
RU 2211305 C1 8/2003
RU 2213844 C1 10/2003
RU 2214502 C1 10/2003
RU 2215124 C1 10/2003
RU 2223856 C1 2/2004
RU 2235852 C1 9/2004
RU 2239050 C1 10/2004
RU 2243358 C1 12/2004
RU 2256774 C2 7/2005
RU 2256777 C1 7/2005
RU 2004121833 A 1/2006
RU 2347798 C1 2/2009
RU 2362674 C1 7/2009
RU 2369720 C1 10/2009
RU 2385894 C1 4/2010
RU 2434119 C1 11/2011
RU 2442686 C1 2/2012
RU 2445203 C1 3/2012
RU 2507370 C1 2/2014
RU 2518620 C1 6/2014
RU 2536075 C1 12/2014
SK 500622012 A3 7/2014
WO 9519221 A2 7/1995
WO 9954104 A1 10/1999
WO 2006109035 A1 10/2006
WO 2007077427 A2 7/2007
WO 2007144844 A2 12/2007

(56) References Cited

FOREIGN PATENT DOCUMENTS

| | | | |
|---|---|---|---|
| WO | 2008130107 | A1 | 10/2008 |
| WO | 2011113096 | A1 | 9/2011 |
| WO | 2012017358 | A2 | 2/2012 |
| WO | 2015034531 | A1 | 3/2015 |
| WO | 2015034543 | A1 | 3/2015 |
| WO | 2015087106 | A1 | 6/2015 |
| WO | 2015088536 | A1 | 6/2015 |
| WO | 2015094218 | A1 | 6/2015 |
| WO | 2015094323 | A1 | 6/2015 |
| WO | 2015126408 | A1 | 8/2015 |
| WO | 2015130271 | A1 | 9/2015 |
| WO | 2015130284 | A1 | 9/2015 |
| WO | 2015130311 | A1 | 9/2015 |
| WO | 2015152881 | A1 | 10/2015 |
| WO | 2015183372 | A1 | 12/2015 |
| WO | 2016005610 | A1 | 1/2016 |
| WO | 2016019219 | A1 | 2/2016 |
| WO | 2016039729 | A1 | 3/2016 |
| WO | 2016048285 | A1 | 3/2016 |
| WO | 2016053290 | A1 | 4/2016 |
| WO | 2016053319 | A1 | 4/2016 |
| WO | 2016057045 | A1 | 4/2016 |
| WO | 2016069618 | A1 | 5/2016 |
| WO | 2016073000 | A1 | 5/2016 |
| WO | 2016077634 | A1 | 5/2016 |

* cited by examiner

MIXING SYSTEM FOR CEMENT AND FLUIDS

BACKGROUND

In a variety of downhole cementing operations, a cement slurry is mixed at a well site via a cement mixing system. The cement slurry is then delivered to a pumping system which is used to pump the cement slurry downhole into a wellbore. For example, the cement slurry may be delivered to a downhole location and forced under pressure into the annular space between a well casing and a surrounding wellbore wall. Upon curing, the well casing is cemented in place within the wellbore and the space between the well casing and the surrounding wellbore wall is sealed. When the cement slurry is mixed, delivery and handling of the powder cement blend and slurry fluid prior to delivery to the pumping system can have a substantial impact on the quality and consistency of the cement slurry.

SUMMARY

In general, the present disclosure provides a system and methodology for facilitating mixing of a slurry such as, but not limited to, a cement slurry for use in a cementing application or other application. The system may be used for mixing a variety of slurries and/or other fluid mixtures. A mixer is provided with a tank, e.g. a conical tank, having a powder cement blend inlet and a mixing liquid inlet. A mixing assembly also may be positioned below the tank and driven by a shaft. The mixing assembly is exposed to an interior of the tank and is used to mix cement slurry when rotated by the shaft and to direct the cement slurry out through a cement slurry discharge. A recirculation system has an inlet positioned to receive a portion of the cement slurry mixed in the mixing assembly. The recirculation system also comprises a passage positioned to direct the portion back into the mixer. In some applications, the system comprises a plurality of mixers, e.g. two mixers, used in combination to facilitate the mixing and cementing operations.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
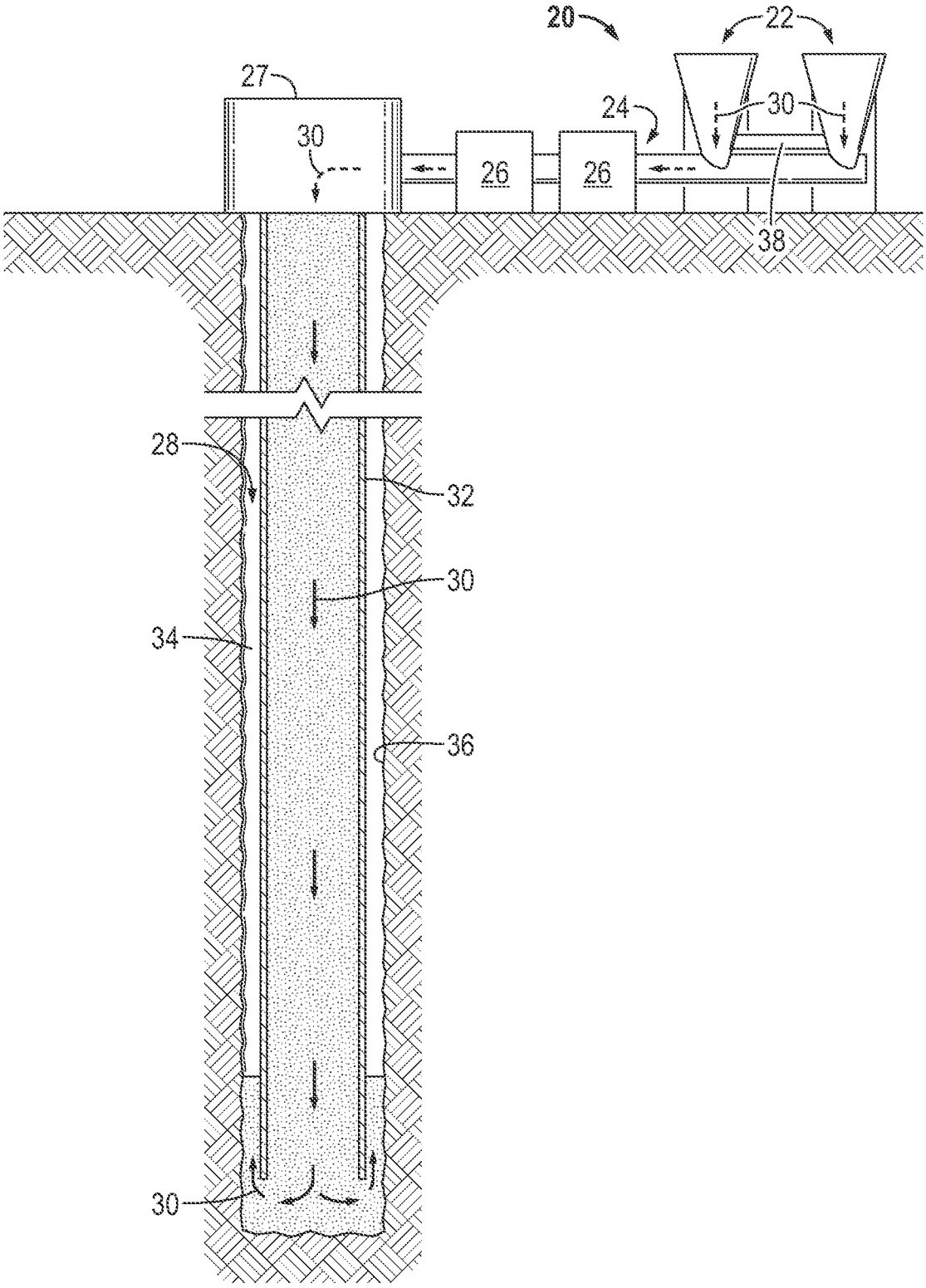
FIG. 1 is a schematic illustration of an example of a cementing system utilized in a well application for delivering a cement slurry downhole into a wellbore, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for facilitating mixing of a slurry, e.g. a cement slurry for use in a cementing application. In cement slurry applications, at least one cement mixer is provided with a tank, e.g. a conical hopper, having a powder cement blend inlet, a mixing liquid inlet, and a cement slurry discharge. The cement slurry discharge may be positioned generally beneath the tank. A mixing assembly also is positioned below the tank and driven by a shaft. For purposes of explanation, the system is described herein as useful for mixing a cement slurry. However, the system and methodology should not be limited to mixing cement slurries and can be used to mix drilling fluids, other types of slurries, and/or other oilfield fluids.

The mixing assembly is exposed to an interior of the tank and is used to mix cement slurry when rotated by the shaft and to direct the cement slurry out through the cement slurry discharge. Additionally, a recirculation system receives a portion of the cement slurry mixed in the mixing assembly and then injects the portion back into the mixer. In some applications, the system comprises a plurality of mixers, e.g. two mixers, used in combination to facilitate the mixing and cementing operations. A flow circuit may be communicatively coupled between the mixers to facilitate control over mixing, delivery of cement slurry, addition of fibers or other additives, and/or solids fraction monitoring and control In embodiments described herein, the configuration of the mixing system as well as the manner of delivering powder cement blend and mixing liquid, e.g. water, enable creation of a vortex which enhances mixing of the cement slurry. Creation of the vortex also enhances air separation from the cement slurry and release of the air through an outlet as a result of the powerful centrifugal separation enabled by the vortex. The outflow of cement slurry substantially free of air also enhances the use and accuracy of a solids fraction monitoring system. Data provided by the solids fraction monitoring system may be used to enhance, e.g. optimize, the delivery of constituents into the mixing system. For example, solids fraction data can be useful for applications in which the cement slurry to be mixed is close to or lighter than water, e.g. applications where density measurements are not as useful. In some applications, a flow restrictor may be used to establish a back pressure which compresses residual air bubbles that may remain in the cement slurry flowing from the cement mixer(s).

The solids fraction monitoring, e.g. solids volume fraction monitoring, may be accomplished by measuring material into and out of a mixing zone of each cement mixer within the mixing system. Because the mixer contains a constant volume of material, measuring the material streams into and out of the mixer enables a remaining stream to be inferred.

In other words, the solids fraction monitoring system may be used to infer the normally difficult to measure stream of bulk solids. Separation of air from the mixture enables a more accurate inference of the desired material stream.

In at least some embodiments, incoming powder such as, but not limited to, dry cement blend powder is mixed directly with mixing liquid, e.g. water, rather than with the slurry such as, but not limited to, the cement slurry. A conically shaped tank, in combination with a mixing assembly, ensures improved mixing within a mixing zone. The mixing assembly may comprise a slinger which works in cooperation with an impeller to thoroughly mix the powder cement blend with water or other mixing liquid. In some applications, a plurality of mixers, e.g. two mixers, can be used to provide flexibility and/or redundancy. The plurality of mixers may be used in combination with a recirculation system having a recirculating/mixing tub which supplies the cement slurry to a pump, e.g. a triplex pump, which then delivers the cement slurry downhole into a wellbore.

Referring generally to FIG. 1, an embodiment of a mixing system 20 is illustrated as employed in a well cementing application. In this embodiment, the mixing system 20 comprises a mixer 22, e.g. a plurality of mixers 22, used to form a slurry or other mixed fluid by mixing a powder blend with a liquid, e.g. water. In cementing applications, the mixer 22 is used as a cement mixer for mixing a powder cement blend with a liquid to form a cement slurry. The powder cement blend may comprise cement and various other additives selected according to the parameters of a given cementing application. Similarly, the liquid may comprise a variety of constituents, e.g. water or water combined with desired additives.

In the embodiment illustrated, the cement slurry is mixed within cement mixers 22 and delivered to a pumping system 24 which may comprise one or more pumps 26, e.g. triplex pumps. The pumps 26 are used to deliver the cement slurry to suitable surface equipment 27 and then downhole into a wellbore 28, as represented by arrows 30. By way of example, the cement slurry 30 may be delivered downhole through a tubing string 32, e.g. a casing string, to a desired location. In some downhole cementing applications, the cement slurry is delivered down through the tubing string 32 via suitable cementing equipment and forced into a surrounding annulus 34 between casing 32 and a wellbore formation wall 36. After the cement slurry 30 is cured, it fills the desired portion of annulus 34. The cured cement secures casing 32 in place and provides a sealed barrier along the annulus 34. However, the cement slurry may be used in other cementing applications.

As described in greater detail below, the plurality of cement mixers 22 may be communicatively coupled via a flow circuit 38. The flow circuit 38 may comprise a variety of controllable valves, flow meters, pumps, flow passages, cement slurry recirculation components, density sensors, and/or other components to facilitate mixing and monitoring of cement slurry 30. Depending on the application, the flow circuit 38 may be controlled to enable use of individual cement mixers 22. However, the flow circuit 38 also may be controlled to enable simultaneous or collective use of the plurality of cement mixers 22. In some applications, a selected cement mixer 22 may be used as a downstream mixer for delivering the cement slurry downhole in wellbore 28. The downstream cement mixer 22 also may be used for mixing in fiber or other lost circulation material so as to avoid introduction of the lost circulation material into various other components of the overall cement mixing system 20.

Figure 2:
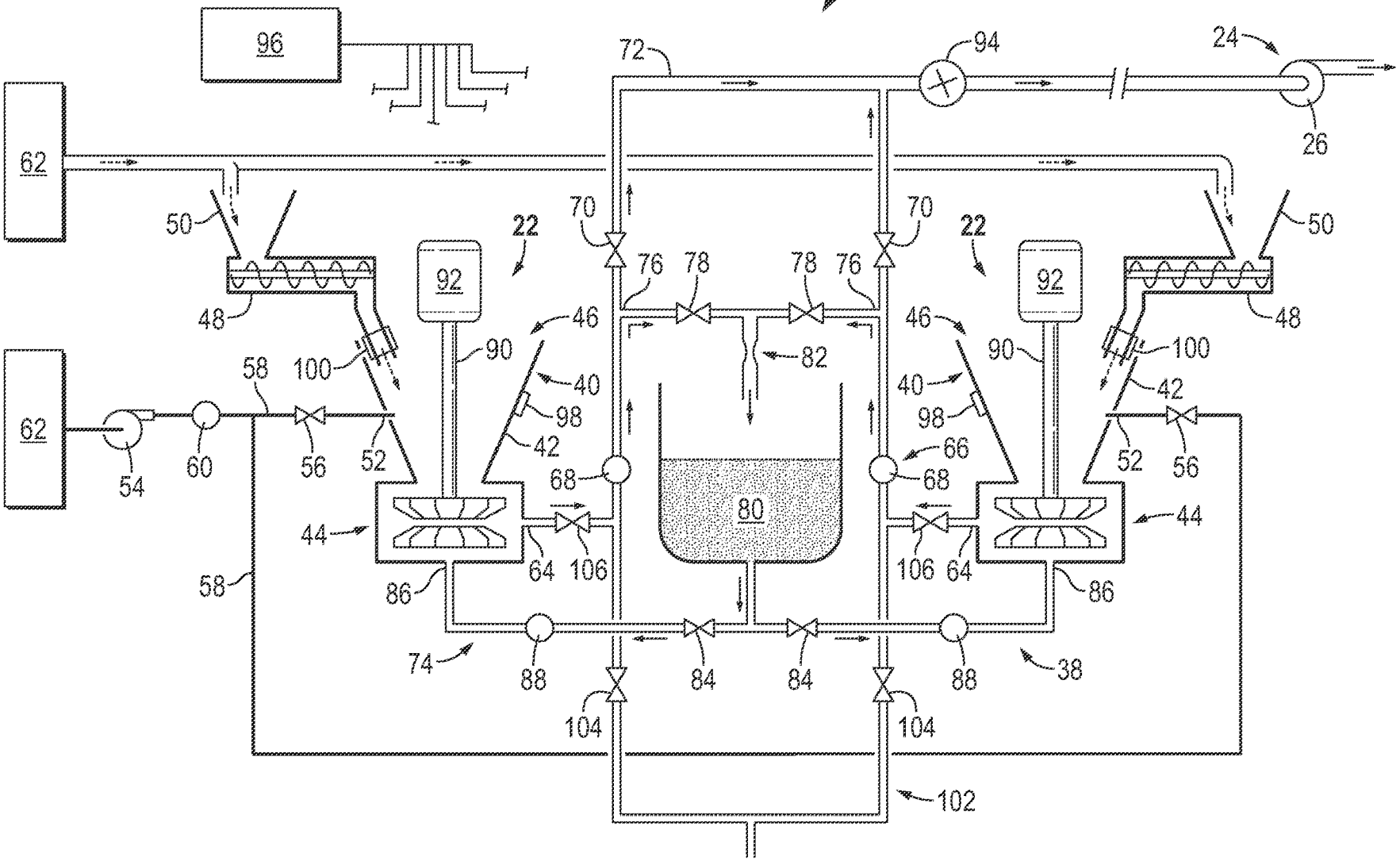
FIG. 2 is a schematic illustration of an example of a cement mixing system which may be used with the overall well application illustrated in FIG. 1, according to an embodiment of the disclosure.

Referring generally to FIG. 2, a schematic illustration is provided to show an embodiment of a mixing system 20 such as, but not limited to, the cement mixing system 20. In this embodiment, the cement mixing system 20 comprises a plurality of cement mixers 22, e.g. two cement mixers, coupled with the flow circuit 38. Each cement mixer 22 comprises a tank 40, e.g. a hopper, which may be in the form of a conical tank having a conical portion 42. The hopper/tank 40 is positioned above a mixing assembly 44 which mixes constituents to form cement slurry 30.

To mix the cement slurry 30, powder cement blend is delivered into tank 40 through a powder cement blend inlet 46 which may be located at the top or at an upper portion of tank 40. By way of example, the powder cement blend may be delivered to inlet 46 by a suitable powder feeder 48 or other suitable powder delivery device working in cooperation with a hopper 50 or other suitable powder receiving device. In some applications, the powder feeder 48 comprises a screw drive powder feeder operated to provide positive volumetric metering of the powder cement blend. However, other types of powder feeders 48 may be used to provide positive volumetric metering of the dry cement blend so as to enable consistent delivery of the dry, powder cement blend.

The mixing liquid, e.g. water, also is delivered into tank 40 of each cement mixer 22 via a mixing liquid inlet 52. The mixing liquid may be delivered to inlet 52 by, for example, a pump 54, valves 56, and supply lines 58. A flow meter or meters 60 also may be used to facilitate monitoring and regulating of fluid flow to inlets 52 of cement mixers 22. By way of example, a control system connected to regulating valves 56 and/or a variable speed motor(s) driving pump 54 may be used to regulate the flow of water or other mixing liquid. The powder cement blend and the mixing liquid may be supplied by a suitable constituent supply system 62, e.g. a conventional supply system, which may comprise a variety of pumps, tubes, tanks, conveyors, loaders, and/or other suitable material handling devices.

As discussed in greater detail below, the liquid inlet 52 of each cement mixer 22 may be oriented to direct mixing liquid into tank/hopper 40 at a tangent with respect to the interior surface of the tank/hopper 40 or at another suitable angle to initiate a centrifugal action which facilitates mixing with the powder cement blend. In some applications, each liquid inlet 52 may be positioned proximate a portion of conical section 42. Additionally, the mixing liquid may be introduced between walls of a dual wall section of the conical portion 42, the dual wall section extending from an upper portion of tank 40 at least partially down toward a bottom of conical portion 42.

Referring again to FIG. 2, once the powder cement blend and mixing liquid are mixed in each cement mixer 22 to form cement slurry 30, the cement slurry is directed out through a cement slurry discharge 64 and into a portion of the flow circuit 38. For example, the cement slurry 30 may be discharged into a solids fraction monitoring system 66 comprising suitable sensors 68, such as non-radioactive densitometers, to enable determination and monitoring of the solids fraction in the cement slurry 30. The cement slurry 30 continues to flow through valves 70 and into a discharge line 72 which directs the cement slurry to pump(s) 26 of system 24.

However, a portion of the cement slurry 30 may be directed into a recirculation system 74. The recirculation system 74 may comprise a variety of features depending on the parameters of a given mixing application. According to the illustrated embodiment, however, the recirculation system 74 comprises an inlet 76 associated with each cement mixer 22 and positioned to receive the recirculation portion of the cement slurry 30. After passing through inlet 76, the portion of the cement slurry 30 flows through valves 78 and into a recirculation mixing tank, e.g. tub, 80. By way of example, the portion of cement slurry 30 may pass through a restrictor 82 before entering recirculation mixing tub 80. The restrictor 82 may be used to help establish a desired back pressure which, in turn, helps to minimize air pockets, e.g. residual air bubbles, in the cement slurry.

From recirculation mixing tub 80, the recirculated portion of cement slurry 30 passes out of recirculation mixing tub 80, through corresponding valves 84, and through a passage/port 86 for injection back into mixing assembly 44. In at least some applications, the recirculated portion of cement slurry 30 may be flowed through a corresponding flow meter 88 before being returned into the mixing assembly 44 of the corresponding cement mixer 22.

The mixing assembly 44 of each cement mixer 22 may be powered by a variety of power sources. In the embodiment illustrated, the mixing assembly 44 of each cement mixer 22 is driven by a shaft 90 rotated by a corresponding motor 92, such as an electric motor. In a top drive style cement mixer 22, the motor is positioned above tank 40 and the shaft 90 extends down through tank 40 to mixing assembly 44. However, the cement mixer 22 may have other configurations, such as a bottom drive style in which the motor and shaft are disposed below the tank 40 of mixing assembly 44. In a bottom drive configuration, a seal assembly may be used to provide a seal about the shaft 90 where it passes through the mixer housing containing mixing assembly 44.

Depending on the application, fibers or other lost circulation material may be added to the cement slurry 30. In some applications, the fibers or other additives are introduced into the cement slurry downstream of the recirculation mixing tub 80. The flow circuit 38 may be adjusted to utilize one of the cement mixers 22 as a downstream mixer. For example, the appropriate valve or valves 78 may be closed to prevent introduction of the fiber-laden cement slurry into mixing tub 80. In other embodiments, however, an additional mixer 94 may be positioned along discharge line 72 upstream of pump(s) 26 to facilitate addition of the desired additives at a location downstream of the cement mixers 22.

According to an embodiment, a control system 96 may be used to receive data and to control various aspects of the overall mixing system 20. By way of example, the control system 96 may be coupled with constituents supply system 62, feeders 48, solids fraction monitoring system 66, flow meters 60, 88, and valves 56, 70, 78, 84 to receive data and/or to control flow along flow circuit 38. In some applications, the control system 96 may be coupled with sensors 68 of solids fraction monitoring system 66 to process the data and to determine the solids fraction of cement slurry 30. Based on the solids fraction of the cement slurry, adjustments to the flow of powder cement blend and/or mixing liquid may be made via control system 96.

For example, based on the data received the control system 96 may output information to an operator and/or automatically control the amount of powder cement blend and/or mixing liquid delivered to each cement mixer 22. According to an embodiment, the control system 96 may be used to control operation of screw drive feeders 48 to provide positive volumetric metering of the dry cement blend. The control system 96 also may be used to selectively open and close valves 56, 70, 78, 84 in a manner which enables operation of individual cement mixers 22 or collective operation of the plurality of cement mixers 22. For example, control system 96 may be used to operate valves 56 and/or control pump 54 in cooperation with flow meters 60 so as to provide metering of the mixing liquid, e.g. water, introduced into each cement mixer 22. The control system 96 also may be utilized to control flow of cement slurry 30 through recirculation system 74. By way of example, control system 96 may be a computer-based control system programmable to achieve the desired mixing and delivery of cement slurry 30.

Depending on the application, cement mixing system 20 also may comprise various other features and components. For example, vibration components 98 may be coupled with each tank 40 to vibrate the walls of tank 40 as dry powder is delivered into each cement mixer 22. The vibration helps move the dry cement blend downwardly along conical portion 42 to the mixing assembly 44. By way of example, the vibration components 98 may comprise pneumatic or hydraulic vibrators mounted to, in an embodiment, an exterior surface of each tank 40.

Additionally, mass flow sensors 100, such as impact or deflection flow sensors, may be used to monitor the mass of dry cement blend delivered into each tank 40 via the corresponding feeder 48. The mass flow sensors 100 are coupled with control system 96 to enable very accurate monitoring of the amount of dry cement powder blend being introduced into each mixer 22, thus enabling a more precise control over delivery of constituents for forming the cement slurry 30. The control system 96 also may be used to control metering and delivery of water or other mixing fluid to ensure the desired ratio of constituents in the cement slurry.

In some applications, flow circuit 38 may incorporate a bypass circuit 102 for delivering other materials downhole. For example, bypass circuit 102 may be used to deliver drilling mud or other materials downhole via pumping system 24. According to the example illustrated, the bypass circuit 102 is ultimately coupled with discharge line 72 across valves 104. The drilling mud or other material introduced via bypass circuit 102 also may be flowed through sensors 68 and valves 70. Shut off valves 106 may be closed via control system 96 during use of bypass circuit 102 to ensure the drilling mud or other material does not enter cement mixers 22.

Figure 3:
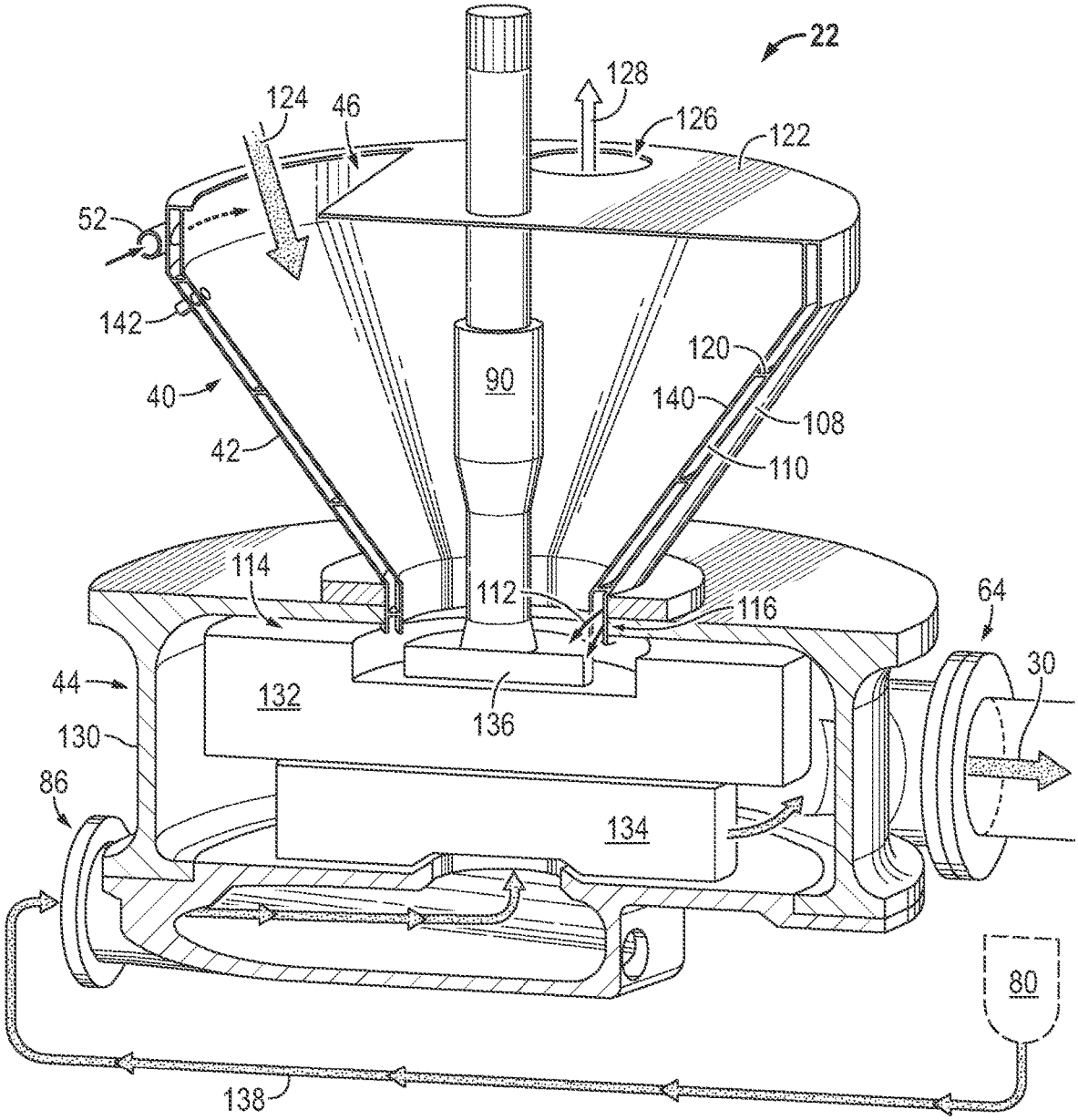
FIG. 3 is a cross-sectional view of an example of a cement mixer which may be used in the cement mixing system illustrated in FIG. 2, according to an embodiment of the disclosure.

Referring generally to FIG. 3, an embodiment of one of the cement mixers 22 is illustrated. In this example, tank 40 may comprise a structure having a dual wall 108 creating an interior 110 along which the mixing liquid, represented by arrow 112, may flow in a circulating pattern, e.g. a helical pattern, before being discharged into a mixing zone 114 through a mixing liquid discharge outlet 116. It should be noted the dual wall 108 may be formed with different lengths. For example, the dual wall 108 may extend downwardly over a portion of the conical section 42, e.g. over about one half or over about three quarters of the vertical length of conical section 42. In some embodiments, the dual wall 108 terminates to provide a single wall structure at the entry region of mixing zone 114 within mixing assembly 44. Additionally, some embodiments may replace the dual wall 108 entirely with a single wall. In some embodiments, the mixing liquid 112, e.g. water, may be delivered into tank 40 via other techniques, e.g. by allowing the mixing liquid to drip or spray down from a plurality of jets arranged to effectively create a curtain of water dropping straight down into tank 40.

Figure 4:
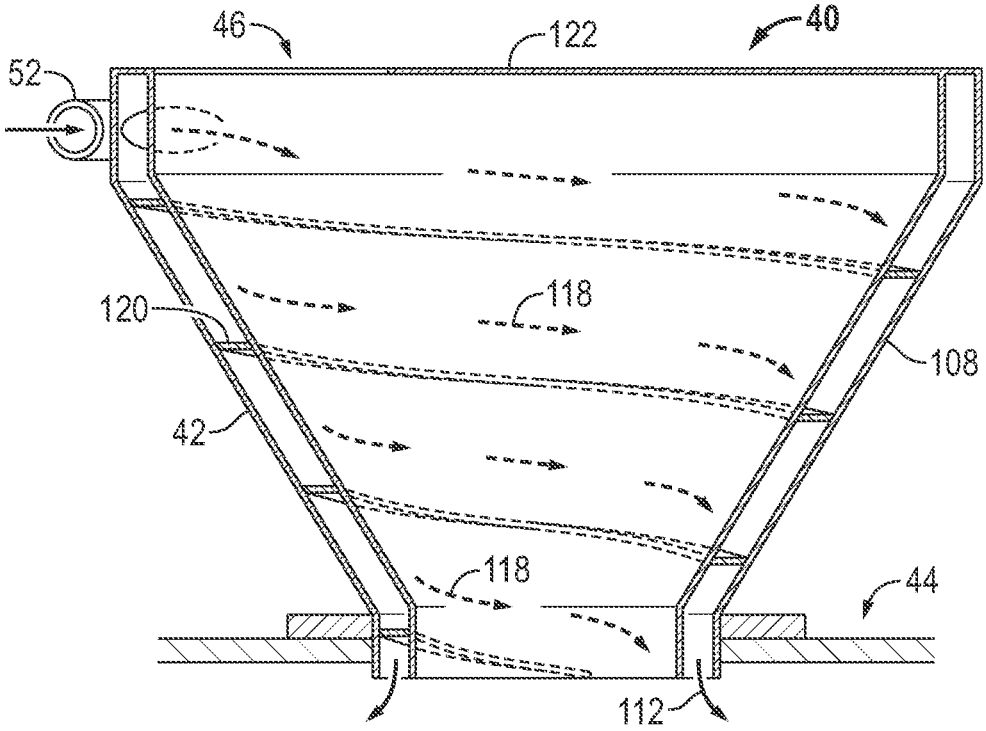
FIG. 4 is a schematic illustration of an example of a conical mixing tank of a cement mixing system, the conical mixing tank being constructed to deliver a mixing liquid to a lower portion of the conical tank in a manner which facilitates mixing of a cement slurry.

With additional reference to FIG. 4, the mixing liquid inlet 52 may be positioned generally towards an upper portion of conical section 42 of tank 40. In this example, the inlet 52 is oriented to direct the inflowing fluid in a generally helical pattern 118 downwardly along conical section 42 until introduced into mixing assembly 44. The centrifugal action created by the helical flow pattern 118 creates swirl which enables mixing liquid, e.g. water, entering the mixing assembly 44 to centrifuge outwardly. This tends to increase the mixing liquid surface area which maximizes contact with the powder cement blend. However, the mixing liquid entering the mixing assembly 44 should be metered properly so as to not overly flood the mixing zone 114 and the powder cement blend moving into the mixing zone 114. In some applications, a helical divider or guide vane wall 120 may be routed along conical section 42, e.g. between the walls of dual wall 108, to facilitate the helical, centrifuging flow of water/mixing liquid along conical section 42 and as the mixing liquid exits the conical portion. Depending on the embodiment configuration, the helical, centrifugal flow of the mixing liquid may be obtained or enhanced by, for example, the orientation of fluid inlet 52, guide vane 120, double wall 108, and/or combinations of these features. It also should be noted liquid inlet 52 is illustrated proximate the top of conical tank 40, but the inlet 52 may be positioned at other locations along tank 40 to change the mix liquid injection point, e.g. to place the injection point at a lower position along conical section 42.

In the embodiment illustrated in FIGS. 3 and 4, the tank 40 also may comprise a top portion 122 having powder cement blend inlet 46 through which dry solids product, e.g. powder cement blend, is introduced into the interior of tank 40, as represented by arrow 124. The top portion 122 also may comprise an air outlet 126 for releasing air, as represented by arrow 128. The air 128 is released during the centrifuging action of powder cement blend 124 and cement slurry 30 in mixing zone 114. In some applications, the released air 128 may be passed through a dust collector or other type of filter system.

In the embodiment illustrated, mixing assembly 44 comprises an outer housing 130. Within outer housing 130, the mixing assembly 44 comprises a slinger 132 which is rotated by shaft 90 to initiate mixing of the powder cement blend 124 and mixing liquid 112. The slinger 132 initiates the mixing by slinging powder cement blend into the mixing liquid and then delivers the constituents to an impeller 134. The impeller 134 continues to mix the powder cement blend 124 and mixing liquid 112 before directing the resulting cement slurry 30 outwardly under pressure through the cement slurry discharge 64.

In certain embodiments, the slinger 132 is larger in diameter than the pressurizing impeller 134 and turns at the same rotational speed. The impeller 134 creates pressure while the larger diameter slinger 132 helps open up a vortex or free surface of the mixing liquid at atmospheric pressure so that solids material, e.g. powder cement blend, placed into the eye of the vortex is ingested into the mixing liquid without spills. The vortex also rejects air from the powder cement blend 124 and this air moves to the center of the vortex for release from tank 40 as represented by arrow 128. In some embodiments, a dust control system may be used to remove dust from the released air. It should further be noted that a variety of components and techniques can be used to create the vortex. In general, the slinger 132 works in conjunction with the impeller 134 to create an open vortex eye and the parameters of the vortex may be adjusted by selecting desired attributes of slinger 132 and impeller 134, e.g. diameter, blade height, number of blades, blade angles, and/or other construction attributes. In several types of embodiments, the slinger 132 is of larger diameter than the impeller 134 because the diameter may have the largest impact on the ability of a blade arrangement to generate pressure. Also, in some embodiments, the mixing assembly 44 may comprise an inducer 136 which can be used to actively pump the constituents into the mixing assembly 44. For example, the inducer 136 may be useful in helping to push a lighter, dry-plus-wet input material into a heavier wall of slurry.

As described above, a portion of the cement slurry 30 mixed by mixing assembly 44 may be routed through mixing tank 80 of recirculation system 74 before being directed back into mixing chamber 44 through recirculation passage 86, as represented by flow arrow 138. The reintroduction of recirculated slurry enhances the thorough mixing of the ultimate cement slurry 30 delivered downhole by pump(s) 26. The recirculation system 74 also provides a greater robustness to the mixing capability by enabling compensation for excess amounts of slurry constituents. For example, if too much dry cement blend 124 has been added, additional water may be injected into the cement slurry. However, the primary mixing performed by cement mixers 22 may be achieved by mixing water directly into the powder cement blend 124 rather than into the cement slurry.

Depending on the application, each cement mixer 22 may comprise various other components. For example, slurry walls or other suitable features may be positioned along inducer 136 and/or slinger 132 to guide the cement slurry constituents as desired through the mixing zone 114. In some applications, inner surfaces (e.g. those surfaces contemplated to be in contact with the powder blend 124, the mixing liquid 112, and/or the slurry 30) of tank 40, e.g. conical portion 42, may be coated with a hydrophobic or oleophobic layer 140, e.g. Ultra-Ever Dry™ or Teflon™, to prevent sticking with respect to the inner surface of tank 40 and to facilitate movement of material along the interior of conical portion 42.

Additionally, a level sensor 142 may be positioned along tank 40 at a desired position to provide an indication to control system 96 if the constituents entering the interior of tank 40 rise above a desired level. In some applications, sensor 142 may be used to monitor rising and falling levels within tank 40 to facilitate calculation of net accumulation or depletion of cement slurry constituents in the tank 40 so as to improve the accuracy of solids volume fraction monitoring. As described in greater detail below, however, some embodiments of solids fraction monitoring system 66 enable accurate monitoring without level sensors. The illustrated features and/or other features may be incorporated into the cement mixer 22 according to the parameters of a given cement mixing application.

In operation, the tangential, e.g. helical, flow of the mixing liquid combined with the action of slinger 132 creates a strong centrifugal force at mixing zone 114. The strong centrifugal force further ensures that air ingested with solids is forced toward lower pressure which is toward the eye of the vortex. The air is forced out of the eye of the vortex and forms a countercurrent to the flow of solids, e.g. powder cement blend, into the eye. The air then flows up and out of container 40 through air outlet 126 as indicated by arrow 128.

When mixing cement slurry 30, a high shear on the solids, e.g. powder cement blend, is useful for dispersing the solids into the incoming mixing liquid, e.g. water, stream 112 and into the pre-existing cement slurry. High shear on the solids also shears air bubbles into smaller bubbles which would otherwise not separate well. The creation of the vortex, however, is very effective at removing such air and this improves performance of the downstream slurry pumps 26.

Separation of the air facilitates mixing in a variety of additional ways, including improving the dispersion of dry particles.

Furthermore, separation of air within each cement mixer 22 improves the ability to monitor the solids volume fraction (SVF). By way of example, the calculation of SVF may be according to the following equation: (mix water flow rate in)+(solids volume rate in)=(volume in tank increase per time)+(downhole rate leaving the tank).

Three of these quantities may be measured and the solids volume rate calculated from the equation above. Mixing liquid/water volume and powder cement blend/solids volume may be combined to determine an incoming SVF. According to one method, the outgoing SVF may be calculated. Because the mix can change over time, the SVF of the material within mixing tank 80 is at first assumed, then updated over time to converge on the actual value.

However, the mixing system 20 enables calculation of the SVF without measuring the level of the mix tank, thus making the measurement more accurate. The volume of fluid and solids inside the cement mixer 22 is very nearly constant. With air substantially eliminated and residual air further reduced in volume by pressure, a volume equation for the mixer 22 may be provided as follows: (volume flow of mix water)+(volume flow of solids)+(volume flow of recirculation)=(volume flow out of mixer). The SVF of the incoming mix is then (volume flow of solids)/((volume flow of mix water)+(volume flow of solids)).

To account for changes over time, the initial tank conditions can be integrated into the determination to obtain the outgoing SVF. In some applications, a specific back pressure, e.g. 40-100 psi, may be used on the discharge of each or both mixers 22 to help make density readings output to control system 96 more accurate. If air bubbles exist, the bubble size is substantially reduced by maintaining the back pressure, e.g. by maintaining the back pressure via restriction 82.

In addition to the solids volume fraction, the solids mass fraction (SMF) may be calculated by similar methods. Because there is no accumulation or net discharge of material at the mixer, the balance of flows is described by the equation: (mass flow of mix water)+(mass flow of solids)+(mass flow of recirculation)=(mass flow out of mixer). Three of these quantities may be measured and the fourth calculated. This mass flow equation can be accurate even if air bubbles remain in the fluid after passing through the vortex because the air bubbles have relatively little mass. However, having the air removed facilitates calculation of the actual volume flow of the solids. The mass flow of mix water, mass flow of recirculation, and mass flow out of the mixer can be measured. The fourth quantity of mass flow of solids can then be calculated and combined with the mass flow of mix water to determine a solids mass fraction.

To get the mass flow of mix water, it may be measured directly with a mass flow meter or determined by the combination of density and volume flow rate. In many applications, the mixing liquid may be fresh water with a specific gravity=1.0. In other cases, the mixing liquid density can easily be determined and input to the control system 96. The recirculation mass flow rate may be measured directly with a mass flow meter or determined by the combination of density and volume flow rate, e.g. from flow meter 88. This is the same fluid that is going downhole through the downhole non-radioactive densitometer 68 associated with the cement mixer 22 delivering slurry to the downhole pumps 26. The downhole density measured by densitometer 68 can be combined with the magnetic flow meter reading of flow meter 88 to get a mass flow rate of recirculation. The mass flow out of the cement mixer 22 may be measured with a Coriolis mass flow meter or other type of mass flow meter 68.

The data from sensors 88 and 68 of solids monitoring system 66 may be transmitted to control system 96. Additionally, the mass flow meter 68 located downstream of the corresponding cement mixer 22 provides a density reading with very little delay, thus facilitating control of the incoming cement blend solids rate.

Once both (mass flow of solids) and (volume flow of solids) are known, they can be combined to obtain the average density of the solids. Information about average density of solids is valuable because the dry material is a blend of different materials. There may be cement, silica, bentonite, and other materials like hematite to make the dry material heavier or hollow glass beads or fly ash to make the dry material lighter. Knowing the average density enables a determination as to whether the materials have become segregated during handling. Some hollow-bead materials are vulnerable to damage through breakage during pneumatic conveying from a bulk plant to a transport, from a transport to a silo, and from a silo to the cement mixer. Knowing the average solids density provides information to an operator as to whether, for example, the hollow materials have been damaged (because they take up less volume if they are broken).

The overall cement mixing system 20 uses recirculation system 74 to ensure robust mixing by recirculating the cement slurry 30. The cement slurry can easily be adjusted by adding more water to thin the cement slurry or by adding more dry solids to thicken the cement slurry. In some applications, the mixing liquid, e.g. water, and/or solids, e.g. powder cement blend, can be added to the recirculating cement slurry. The overall circulation rate through the mixer 22 may be controlled by a fixed geometry of the flow path into the recirculation mixing tank 80 and by the controlled speed of each mixing assembly 44. Additionally, the overall circulation rate may be controlled with a regulating valve.

As illustrated, a plurality of the cement mixers 22, e.g. two cement mixers 22, may be used for redundancy. Either mixer 22 can be used individually to recirculate the cement slurry 30 and to pressurize the discharge line 72 toward the downstream pumping system 24. When both cement mixers 22 are available, the appropriate valves of flow circuit 38 may be adjusted to establish a downstream mixer 22 which can be used for the addition of fiber or other lost circulation material. This approach keeps the lost circulation material out of the recirculation mixing tub 80.

According to a specific embodiment (see FIG. 2), two cement mixers 22 are combined with a single recirculation mix tub 80. In this example, the mixing of cement slurry 30 may be achieved with one cement mixer 22 and the downhole pumps 26 may be pressurized with the other mixer 22. If, for example, mixing is performed at the left mixer 22, the mixing liquid, e.g. water, may be measured with flow meter 60. The flow meter may be a magnetic flow meter, but if the water is highly mineralized and at a density other than specific gravity=1.00 a mass flow meter can be used to provide a more accurate reading of the mass flow of this stream.

The mixer 22 draws slurry out of the mixing tank 80 through the flow meter 88. This flow meter 88 can be, for example, a magnetic or mass flow meter. The mass flow of this stream is determined to facilitate calculation of mass fraction and volume fraction and therefore the density is measured. If the mixer 22 on the right side of FIG. 2 is delivering slurry to the downhole pumps 26, its discharge flows through the non-radioactive densitometer 68 illustrated on the right side of FIG. 2. This discharged fluid is the same fluid passing through the recirculating flow meter 88 so, therefore, that density can be combined with the flow of the recirculating slurry to obtain its mass flow rate along with the directly measured volume flow rate. Solids are fed into the top of the mixer 22. The discharge from the mixer 22 is through the corresponding non-radioactive densitometer 68 into the mixing tank 80. Thus, mass and volume flow rates are known for three of the four flows and the mass and volume flow of solids can be calculated.

The embodiment illustrated is symmetrical and therefore redundant. If the mixer 22 illustrated on the right side of FIG. 2 cannot deliver to the downhole pumps 26, an appropriate valve may be opened to let the left mixer 22 feed the cement slurry 30 and also perform the mixing. If the mixer 22 illustrated on the left side of FIG. 2 cannot operate, the appropriate valves may be operated so as to switch the system to using just the right mixer 22. Using one mixer 22 may involve decreasing the flow rate. In some applications, the solids may be fed in a controlled manner by, for example, a volumetric feeder such as a large screw feeder. In some applications, pneumatic conveyance systems also can be employed for feeding the solids to the mixers 22.

Figure 5:
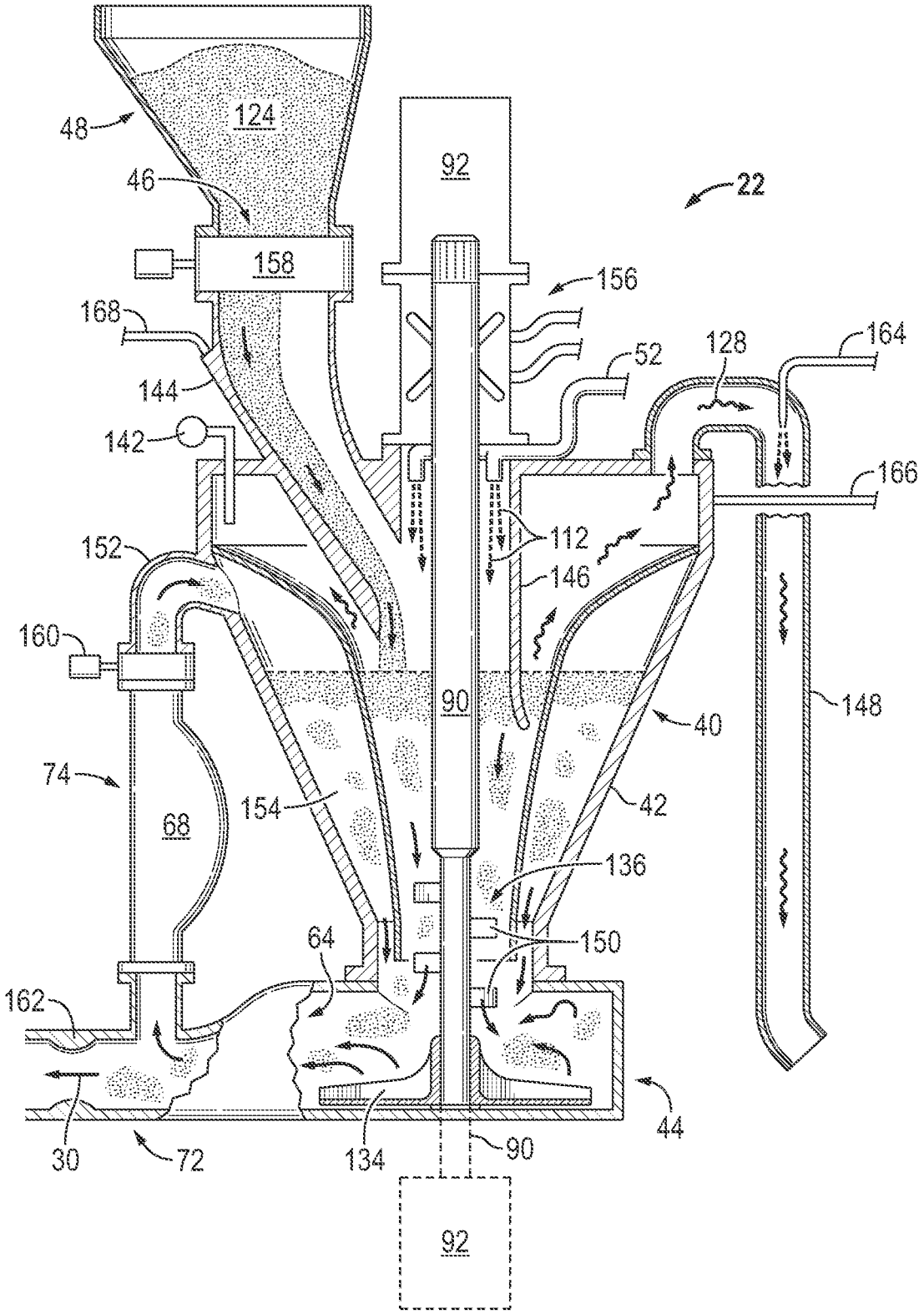
FIG. 5 is a cross-sectional view of another example of a cement mixer which may be used in the cement mixing system illustrated in FIG. 2, according to an embodiment of the disclosure.

Referring generally to FIG. 5, another embodiment of cement mixer 22 is illustrated. In this example, the cement blend inlet 46 is positioned to deliver the dry cement blend 124 into tank 40 via a sealed skirt 144, e.g. an air vibrated sealed skirt. Additionally, the water inlet 52 is positioned to deliver water or other mixing fluid 112 along an interior flow path defined, for example, by a guide wall 146, e.g. a sleeve, positioned generally along shaft 90. The air 128 separated from the dry cement blend 124 and/or cement slurry may be routed out of tank 40 via an air vent housing 148. Similar to the previously described embodiment, the cement mixer 22 may comprise mixing assembly 44 having impeller 134 and/or slinger 132 to create the desired vortex for mixing of cement slurry constituents while also separating air. As illustrated, the mixing assembly 44 also may comprise inducer 136 which may be constructed with a series of paddles 150 coupled to shaft 90.

In this example, the cement slurry 30 is moved out of mixing assembly 44 through cement slurry discharge 64. A portion of the discharged cement slurry may be routed through recirculation system 74 and through a corresponding sensor 68, e.g. a non-radioactive density sensor, which may be coupled with control system 96. In this embodiment, the recirculated portion of the cement slurry 30 is flowed back into tank 40 via a tank inlet 152, e.g. a tangential entry inlet, positioned toward an upper region of the tank 40. The recirculated portion is then routed down through a corresponding chamber or chambers 154 and back into mixing chamber 44 as illustrated.

In the embodiment illustrated in FIG. 5 (and in other embodiments described herein) various other and/or additional features may be incorporated into the overall system. For example, the cement mixer motor 92 may be cooled by a cooling system 156, e.g. a liquid cooling system routing cooling fluid through a motor coolant housing. Additionally, this embodiment and other embodiments may be powered by motor 92 arranged in a top drive configuration, as illustrated by solid lines, or in a bottom drive configuration, as illustrated by dashed lines.

Examples of other features comprise a cement blend quick shutoff 158 positioned to enable rapid shut off of powder cement blend 124 at inlet 46. A valve or valves 160 may be positioned along recirculation system 74 so as to enable control over flow, e.g. shut off of flow, along the recirculation system. A flow restrictor 162 may be used to establish back pressure for ensuring a desired flow through recirculation system 74 as well as compression of air bubbles. In some applications, a mist vent 164 may be positioned along air vent housing 148 to control dust that may be carried by the airflow 128. Similarly, cleanup vents 166, 168 may be positioned to deliver a cleaning liquid, e.g. water, to an interior of tank 40 and an interior of sealed skirt 144, respectively. The vents 166, 168 may be used to deliver liquid which cleans unwanted material from the corresponding interior surfaces.

The system and methodologies described herein also may be employed in non-well related applications in which cement slurries or other mixtures are prepared. For example, the mixer 22 may be used to mix a variety of other types of slurries and/or fluid mixtures. Embodiments of the cement mixer 22 also may be utilized in batch mixing systems. Additionally, the size and configuration of components used to construct each cement mixer 22 and overall mixing system 20 may be adjusted according to the parameters of a given application and/or environment. In some applications, various other and/or additional sensors may be incorporated throughout the flow circuit. The content of the cement slurry constituents, e.g. solids and liquids, may be adjusted according to the parameters of a given cementing application.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a tubing string positioned in a wellbore to receive a cement slurry;

a pump to deliver the cement slurry to the tubing string; and a mixer system to mix the cement slurry for delivery to the pump, the mixer system comprising:

a plurality of mixers communicatively coupled by a flow circuit having a plurality of valves operable to enable cooperative use of the plurality of mixers; and a solids fraction monitoring system to facilitate control over delivery of powder cement blend into the plurality of mixers, each mixer comprising:

a mixing tank having a conical portion, the mixing tank having a powder cement blend inlet and a mixing liquid inlet and a mixing assembly positioned below the mixing tank, the mixing assembly being operable to create a vortex which facilitates mixing of the powder cement blend with mixing liquid while enhancing release of air to create a cement slurry, wherein the mixing assembly comprises a first inlet from the mixing tank, a second inlet from a recirculation system, and an outlet to the recirculation system, wherein the second inlet is positioned opposite from the first inlet.

2. A system, comprising:

a tubing string positioned in a wellbore to receive a cement slurry;

a pump to deliver the cement slurry to the tubing string; and a mixer system to mix the cement slurry for delivery to the pump, the mixer system comprising:

a plurality of mixers communicatively coupled by a flow circuit having a plurality of valves operable to enable cooperative use of the plurality of mixers; and a solids fraction monitoring system to facilitate control over delivery of powder cement blend into the plurality of mixers, each mixer comprising:

a mixing tank having a conical portion, the mixing tank having a powder cement blend inlet and a mixing liquid inlet and a mixing assembly positioned below the mixing tank, the mixing assembly being operable to create a vortex which facilitates mixing of the powder cement blend with mixing liquid while enhancing release of air to create a cement slurry, wherein the mixing assembly comprises a first inlet from the mixing tank, a second inlet from a recirculation system, and an outlet to the recirculation system, wherein the mixing tank comprises a dual wall section extending from an upper portion of the mixing tank at least partially down toward a discharge to the mixing assembly, the dual wall section comprising two walls having an interior therebetween.

3. A system, comprising:

a tubing string positioned in a wellbore to receive a cement slurry;

a pump to deliver the cement slurry to the tubing string; and a mixer system to mix the cement slurry for delivery to the pump, the mixer system comprising:

a recirculation system; and at least one mixer, each mixer comprising:

a mixing tank, comprising:

a conical portion;

a powder cement blend inlet;

a mixing liquid inlet;

an isolated inlet from the recirculation system, wherein a chamber defining an isolated flow path extends from the isolated inlet to a discharge port of the mixing tank; and at least one air vent; and a mixing assembly fluidly connected to the discharge port of the mixing tank, the mixing assembly having at least one rotatable mixing element selected from an impeller and a slinger.

4. The system of claim 3, wherein the conical portion extends from an upper portion of the mixing tank to the discharge port, and wherein the powder cement blend inlet and the mixing liquid inlet open at the upper portion of the mixing tank.

5. A system, comprising:

a tubing string positioned in a wellbore to receive a cement slurry;

a pump to deliver the cement slurry to the tubing string; and a mixer system to mix the cement slurry for delivery to the pump, the mixer system comprising:

a recirculation system; and at least one mixer, each mixer comprising:

an inlet from the recirculation system and an outlet to the recirculation system;

a mixing tank comprising:

a conical portion;

a dual wall section extending along at least a portion of the conical portion, the dual wall section comprising two walls having an interior therebetween;

a powder cement blend inlet; and a mixing liquid inlet; and a mixing assembly positioned below and fluidly connected to a mixing tank discharge port.

6. The system of claim 5, wherein the mixing liquid inlet opens to the interior of the dual wall section.

7. The system of claim 5, wherein a helical channel is provided within the interior of the dual wall section.

8. They system of claim 5, wherein a mixing liquid outlet is formed at a termination end of the dual wall section.

9. The system of claim 5, wherein the mixing assembly has at least one rotatable mixing element selected from an impeller and a slinger.

* * * * *